US006209234B1

(12) United States Patent
Meyers

(10) Patent No.: US 6,209,234 B1
(45) Date of Patent: Apr. 3, 2001

(54) DRAGLINE RIGGING

(76) Inventor: Thomas Anthony Meyers, 142 Field Street, Mackay, Queensland 4740 (AU)

( * ) Notice: Subject to any disclaimer, the term of this patent is extended or adjusted under 35 U.S.C. 154(b) by 0 days.

(21) Appl. No.: 09/310,946

(22) Filed: May 13, 1999

(30) Foreign Application Priority Data

May 13, 1998 (AU) ..... PP 3474

(51) Int. Cl.[7] ..... E02F 3/58
(52) U.S. Cl. ..... 37/398
(58) Field of Search ..... 37/397, 398, 394, 37/395, 396, 399, 401

(56) References Cited

U.S. PATENT DOCUMENTS 4,791,738 * 12/1988 Briscoe ..... 37/398

5,992,061 * 11/1999 Fleck et al. ..... 37/397

* cited by examiner

*Primary Examiner*—Robert E. Pezzuto

(57) ABSTRACT

A rigging system for dragline buckets includes a unitary adaptor having a hoist equalizer aperture at an upper end thereof and bucket hoist chain connectors extending from opposite sides adjacent a lower end of the adaptor. A connector for a dump block extends forwardly of the adaptor. The hoist equalizer aperture is circular and has transversely rounded bearing surfaces which engage with a cross sectionally rounded support surface of a hoist equalizer to permit relative angular movement between the adaptor and the equalizer. The contact surfaces of the adpator and equalizer are hard faced to reduce wear.

10 Claims, 8 Drawing Sheets

FIG. 4
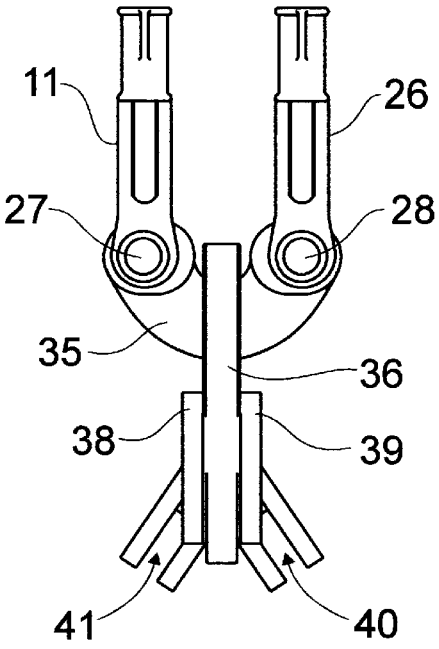
FIG. 5
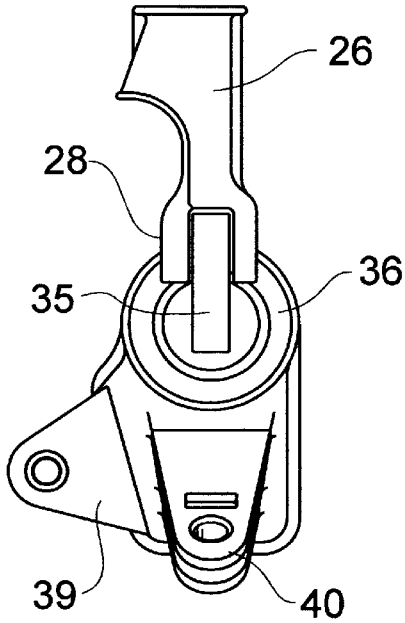
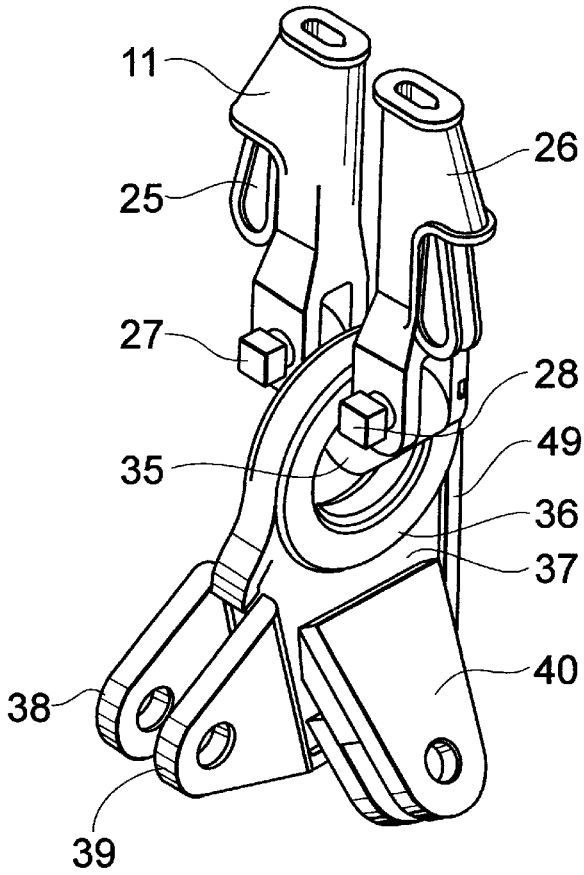
FIG. 6

DRAGLINE RIGGING

FIELD OF THE INVENTION

THIS INVENTION relates to improvements in the rigging by which to support the bucket of a dragline excavator and parts therefore.

BACKGROUND ART

Dragline excavators are commonly employed in tasks such as the removal of overburden in preparation for open cut coal mining. In these, a bucket capable of scooping typically 50 cubic meters of soil is actioned off a boom, which might be typically 50 meters in length. The draglines are sold rated at a particular suspended load for operating purposes. The suspended load is the total of the weight of the load of overburden picked up, the weight of the bucket, and, additionally, the weight of the rigging which supports the bucket off the boom and couples to it to enable its action, the rigging being the assembly of elements and cable by which the bucket is suspended and operated.

The design of dragline rigging is well settled. It has remained in common use, largely unchanged, over a substantial number of years. The assembly supporting the bucket off its lifting cable, and interlinked with the drag line bucket, is typically an array of linkages between a hoist socket and a trunnion link, respective elements being interconnected by swivel pins of the like. The bearing surfaces between these elements wear over time, and they require regular servicing. Normally the dragline excavator is operated continuously, being shut down only every two to three weeks for a matter of hours, typically eight, in which to effect servicing. The down time represents a significant operational cost and management seeks to minimise it. Servicing the wear points is pre-planned. An inspection of expected wear points is made during a short stoppage, some days before a service is expected. This enables acquisition of what replacement parts might be needed in preparation for their being installed.

Either or both of a reduction in weight of the rigging, or the down time taken in servicing it, will have a significant impact on the overall economics of drag line operation.

OBJECT OF THE INVENTION

It is an object of the present invention to effect improvements in the rigging by which to support and/or control the bucket of a drag line excavator, in particular to the upper rigging with a view to one or more of a reduction in rigging weight, a reduced inventory of parts, or a reduction in down time at servicing the dragline rigging. Various other objects and advantages will hereinafter become apparent.

OUTLINE OF THE INVENTION

The invention achieves its object in provision of a dragline rigging adaptor by which to support a dragline bucket in which there is an equalizer encircling means at a first end and first and second connection points, substantially at a second end, at which to fit a dragline bucket and a dragline dump block. The dragline rigging adaptor may have an equalizer shaped with a substantially concave surface at which the equalizer encircling means engages, in use. The dragline rigging adaptor may have its load bearing surface in the upper segment of the equalizer encircling means hard faced. The dragline rigging adaptor may be formed with the hard facing extended substantially over the length of the upper half of the equalizer encircling means. Additionally the load bearing surface of the equalizer may be hard faced.

The invention provides in a particular form dragline rigging by which to support and operate a dragline bucket having a hoist line equalizer with an upper weight bearing surface at which to take the load of the bucket, and a link member with an equalizer encircling means, dragline bucket support pins and dump block pins. The dragline rigging ideally has its mating surfaces of the hoist line equalizer and the encircling member may be rounded in a complementary fashion to permit relative angular movement whilst maintaining contact over a sufficiently extended surface area to optimise load bearing and wear. These mating surfaces are ideally hard faced.

The mating surfaces of the hoist line equalizer and the encircling member may be rounded in a complementary fashion to permit relative angular movement whilst maintaining contact over a sufficiently extended surface area to optimise load bearing and wear as the parts swivel and pivot in use.

Use of the above defined encircling member advantageously reduces the number of links and pivot pins deployed in suspension and operation of the bucket. Additionally, the encircling member has the advantage of effecting a weight reduction over the weight of the equivalent prior rigging, typically from a prior 2 tonne assembly to around 1.0 tonne equivalent in respect of the present proposal. This reduction can enable a potential increase in the bucket capacity to move more overburden over a year, effecting a saving typically of the order of $750,000 per annum. The reduction in pieces and material from the prior style upper rigging can reduce the cost of the new equivalent component over the older upper rigging by a figure of the order of $10,000. A further advantage arises in a reduction of the number of pins whose bushes need replacing. This work is not without hazard and its reduction has its benefits.

BRIEF DESCRIPTION OF THE DRAWINGS

The invention will now be described with reference to various preferred embodiments which are shown in the accompanying drawings, in which:

FIGS. 4 to 6 are elevations and a perspective of a rigging component in accordance with an embodiment of the invention which serves to substitute for the component of FIG. 3;

PREFERRED EMBODIMENTS

Figure 1:
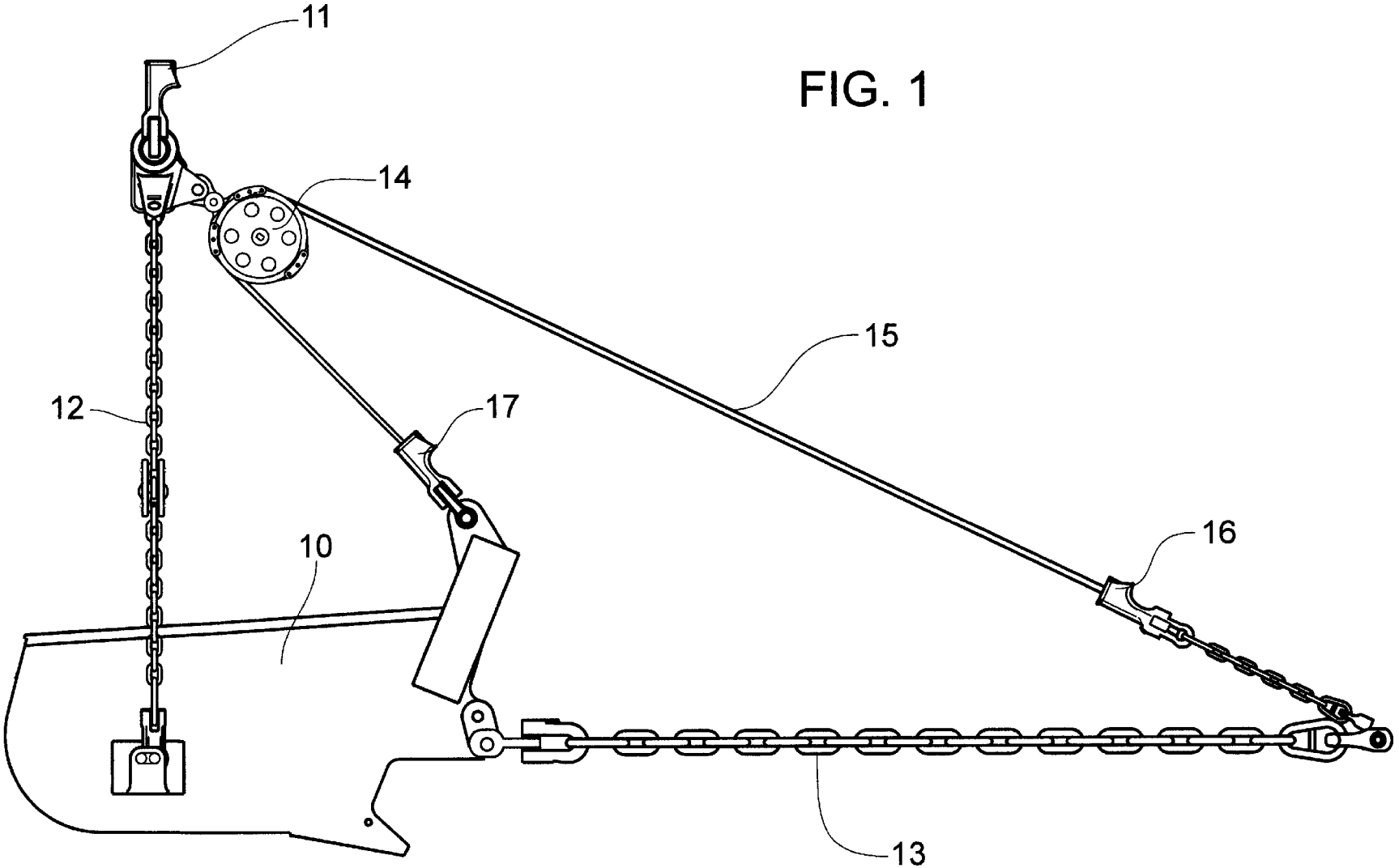
FIG. 1 illustrates the prior art manner of rigging applied to a drag line bucket.

In FIG. 1 is seen the rigging applied to a bucket 10 in the manner of the prior art. Bucket 10 is hung from a hoist socket 11 by which the bucket is hung from a boom (not shown) on a cable terminated in the socket 11. The weight of the bucket 10 is transmitted by chains 12, and it is actioned with draw chain 13 in the usual manner. Control cable 15 loops around pulley 14 between sockets 16 and 17. Details of these are well known to those skilled in the nature of the equipment.

Figure 2:
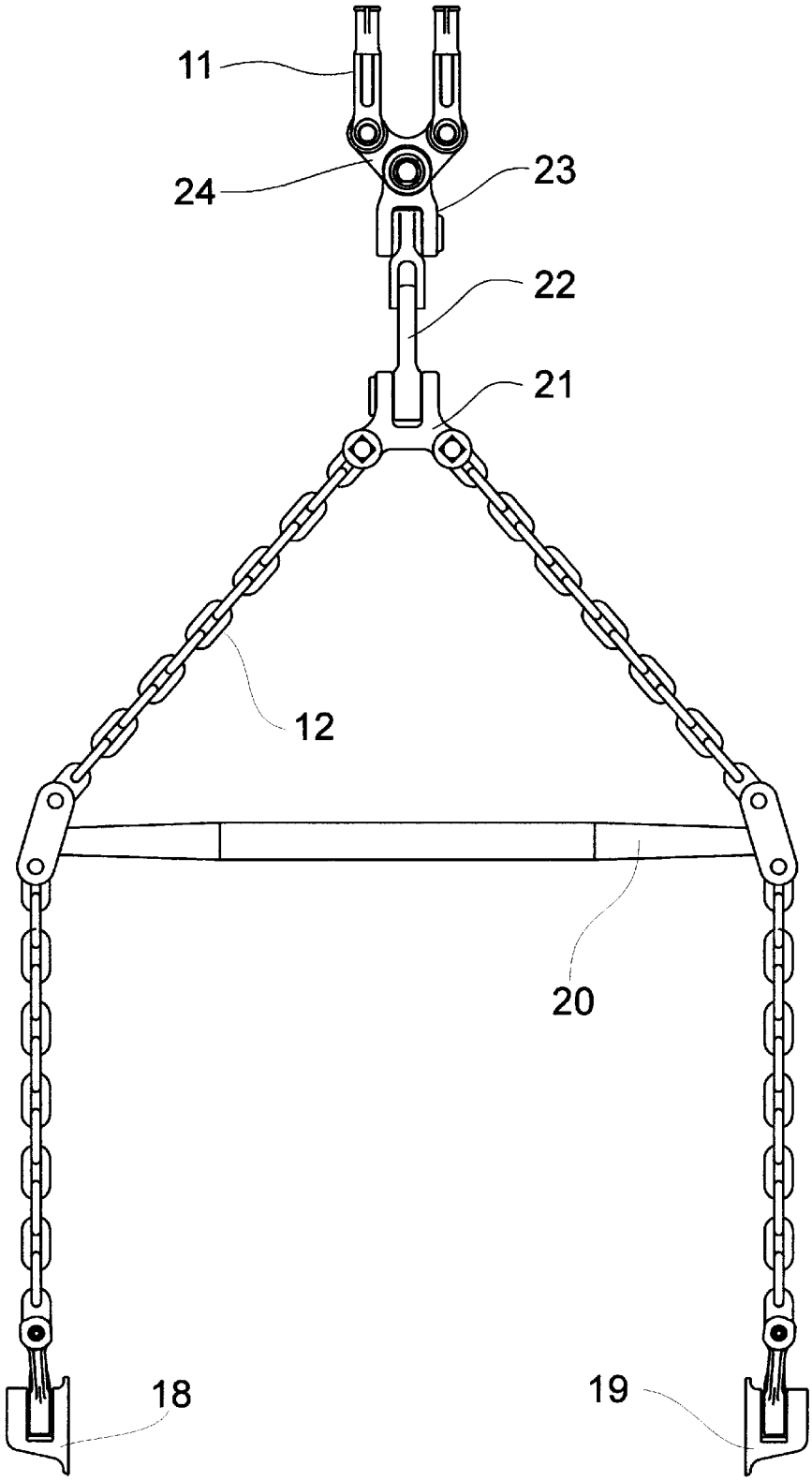
FIG. 2 shows a view of a portion of the rigging of FIG. 1 looking at it from the left of FIG. 1.

In FIG. 2 is seen the rigging of FIG. 1 as it will be seen from behind the bucket (not shown). The bucket may be suspended via trunnions 18, 19 and respective trunnion pick up links off chains depended from spreader 20 and thereabove off hoist clevis 21. A link 22 and link 23 complete the rigging to the hoist socket 11.

Figure 3:
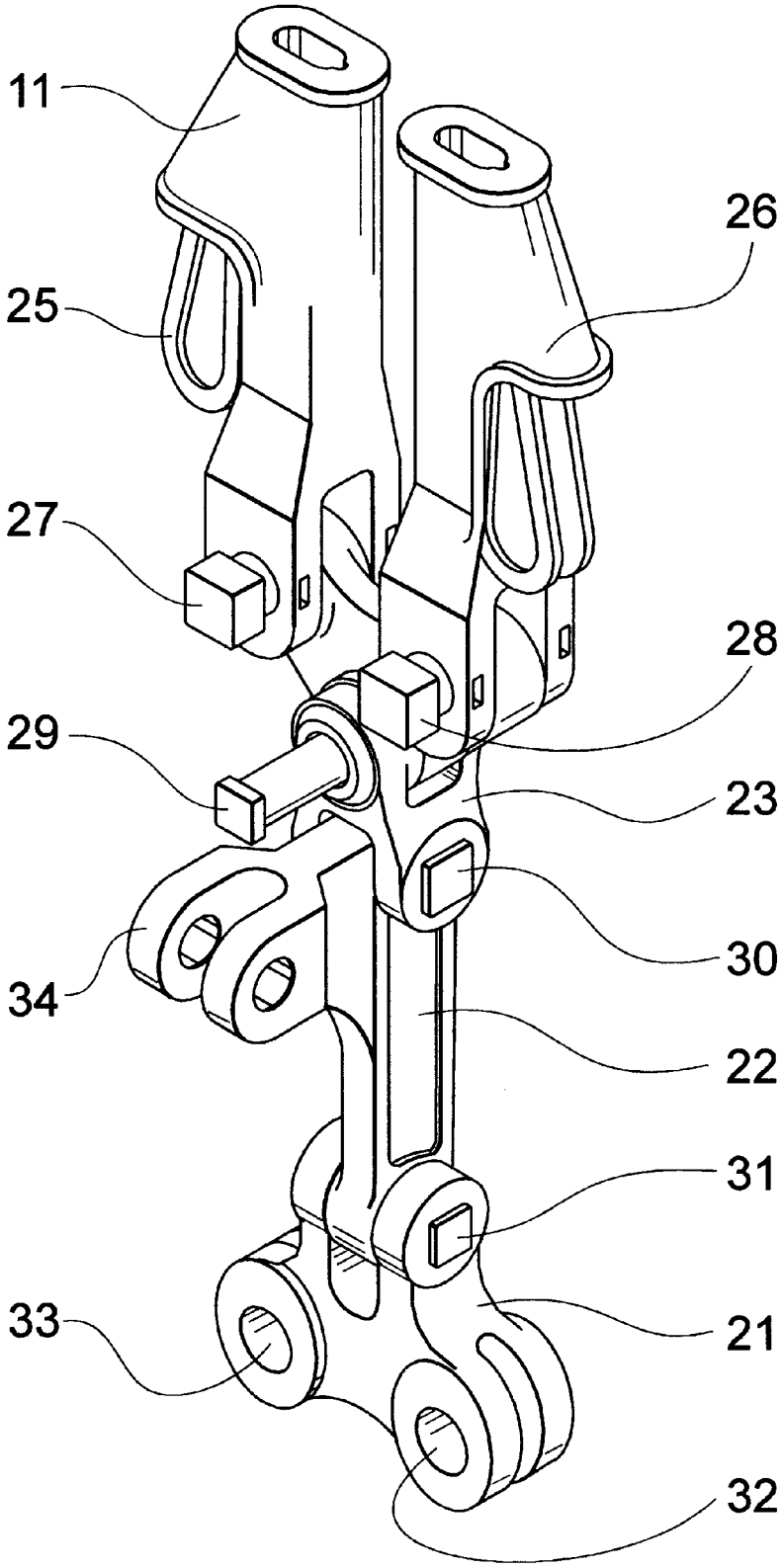
FIG. 3 is a detailed perspective view of the rigging component between bucket and hoist as seen in FIGS. 1 and 2.

In FIG. 3 is a perspective view of the links to the rigging of the above prior art. Hoist socket 11 with cable clamp 25 is mirrored by socket 26, each attached to the hoist equalizer 24 on respective pins 27, 28. The equalizer link 23 is attached to the hoist equalizer 24 via pin 29 (shown partially removed), and it supports swivel line 22 on pin 30. The hoist clevis 21 is attached by pin 31 and is holed at 32, 33 for pins from which to suspend the bucket chains (not shown). The swivel link 22 is extended forwardly with holed lugs 34 at which to couple the dump block (not shown).

In FIGS. 4 to 6 is seen an embodiment of the present invention's proposed rigging enhancement or substitute for components of the prior art upper rigging assembly of FIG. 3. Again hoist connection means is or are provided and ideally there may be engagement members, preferably in the form of sockets 11, 26 which may engage with or couple to a first load bearing member which is ideally in the form of the illustrated hoist equalizer 35 (hereinafter referred to as an equalizer for the sake of convenience), the attachment of the two being ideally effected via suitable connection means such as the preferred, illustrated pins 27, 28. In this embodiment, the equalizer 35 passes through or otherwise operatively engages with a second load bearing member (hereinafter referred to for convenience as an equalizer engagement means or encircling member of more simply as a ring) which may be substantially shaped or essentially provided, in the preferred form, as an annulus 36 as shown. The respective actions achieved by the equalizer, swivel links and the clevis of the above prior art upper rigging assembly may be achieved within these two entities. Three members and three pins of the prior art may now be replaced by a single entity. The ring 32, is ideally formed in an integral assembly with a body part formed ideally utilizing an essentially plate-form member 37 which may provide or support elements such as lugs 38, 39 which again may connect or engage, in use, with a pulley or the like of the kind as will be familiar to the man skilled in the art, for operative interconnection with the control cable and/or other elements of the rigging of a dragline, as will be familiar from the prior art. The usual bucket support chains (not shown) may be attached, in use, at respective sides, connected to or interacted with holed lug pairs 40, 41 at which standard couplings can be fitted.

Figure 7:
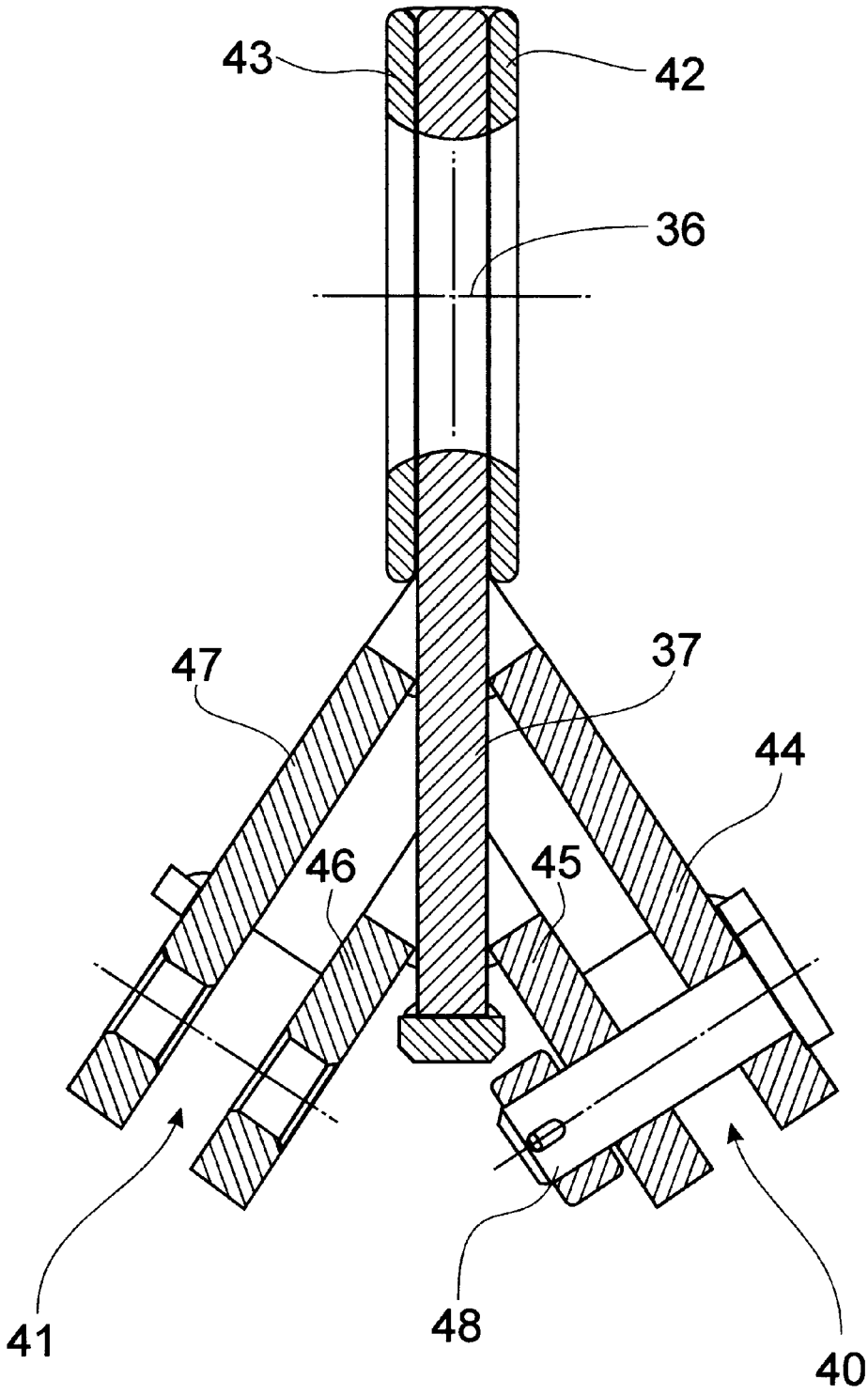
FIG. 7 is a detailed sectional view of the lowermost component of FIGS. 4 to 6.
Figure 9:
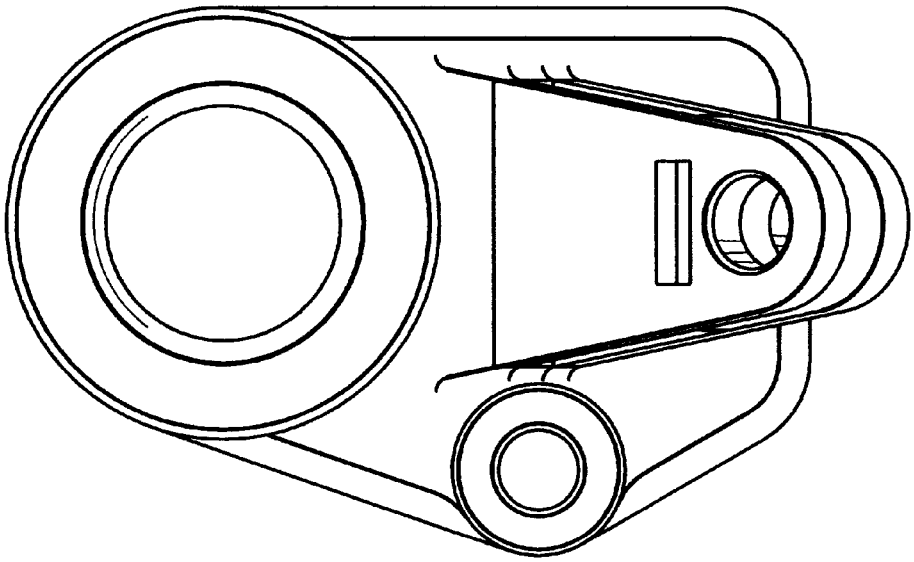
FIGS. 8 and 9 are perspective and elevation of an alternate component to that of FIGS. 4 to 7 presenting alternate connection possibilities to the dump rigging.
Figure 8:
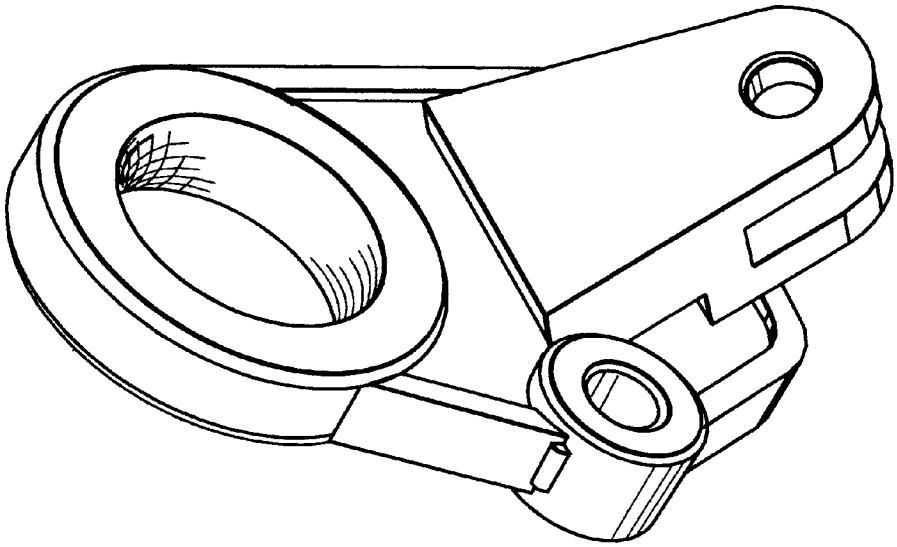

In FIG. 7 is seen a transverse section through the ring of FIGS. 4 to 6. The ring 36 may be established by provision of a hole in plate-like material to which may be joined or otherwise applied, complementary annular pieces 42, 43, ideally welded or otherwise bonded to each of opposed sides or faces of the holed plate 37, positioned to locate around and bordering on the hole in it, as a means by which to build a suitable encircling member. The surface or internal face of the hole in the resulting ring is ideally configured or shaped to create or establish a contact or load bearing surface complimentary to those surfaces of the equalizer which engage therewith, effective across the range a relative angular movements. The load bearing surfaces may be optionally hard faced as set out below. Plate pairs 44, 45 and 46, 47 may be welded at an appropriate angle off the sides of plate 37 to receive pins such as pin 48. The plate 37 may be strengthened with edge flanges 49 (seen in FIG. 6).

Figure 10:
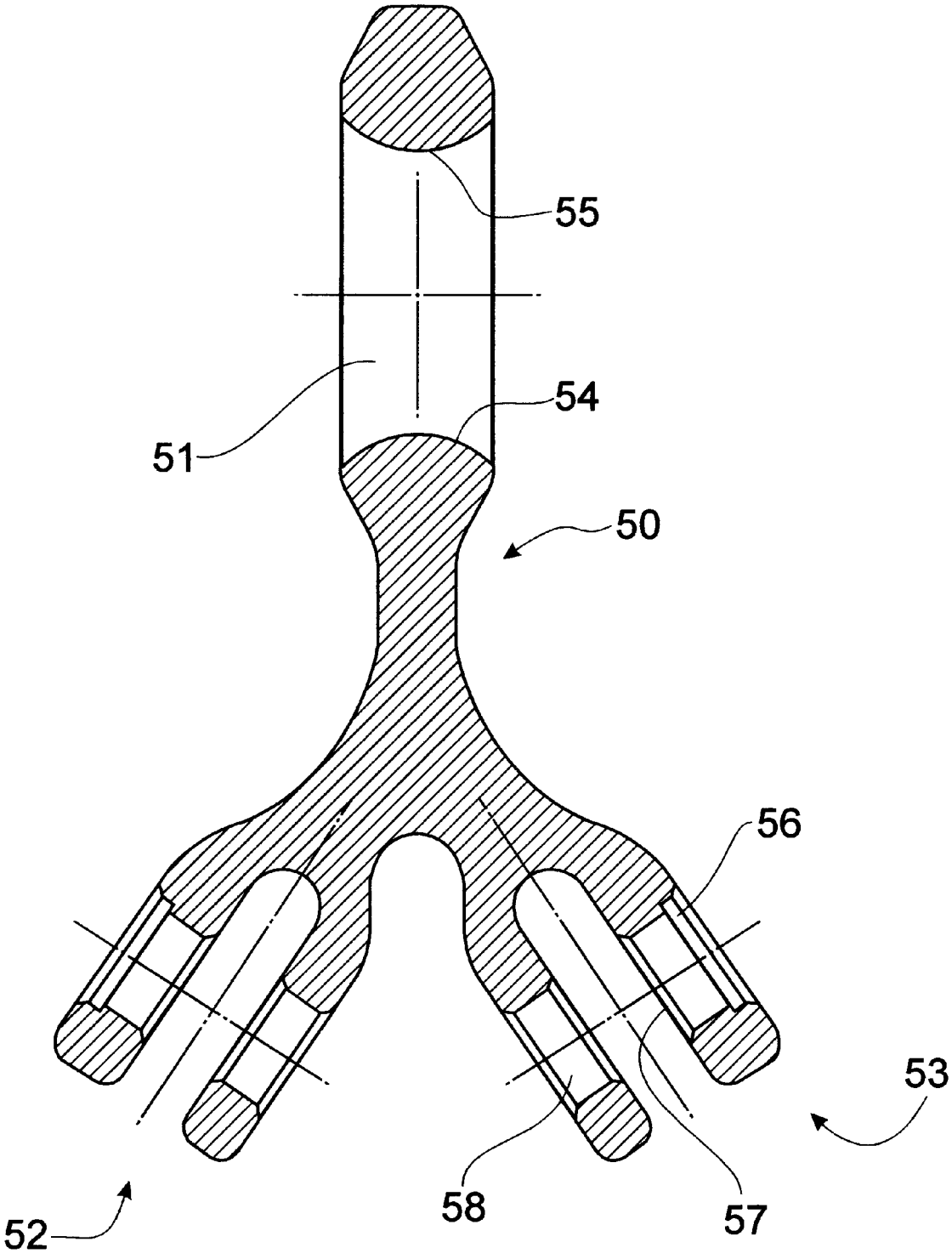
FIG. 10 is a sectional view through a cast form adaptor in accordance with the present invention.

In FIG. 10 is seen an adaptor in transverse section through the equalizer hole 51 with its rounded profile at its engagement surfaces. Also seen is the bucket connector holes 52, 53. These may be formed with a squared section 56 outside pin receiving bore 57, coaxial with bore 58. The square recess enables use of a square headed pin (not shown) so that the pin is held against rotation, as will be known to those skilled in the art.

Figure 11:
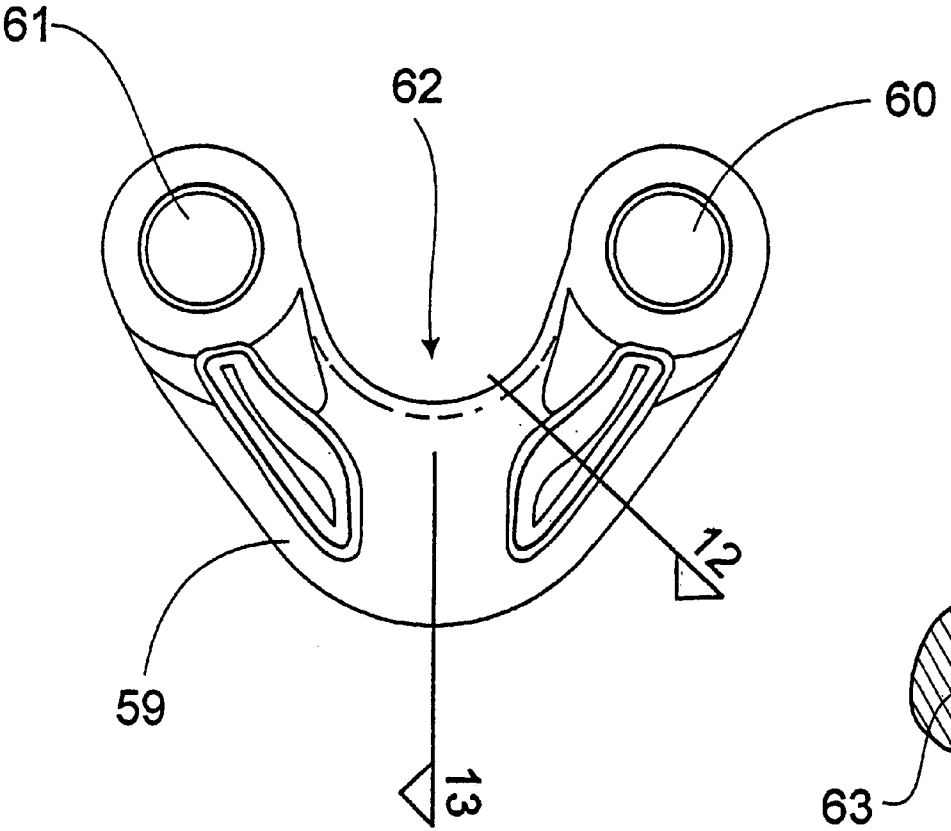
FIG. 11 is an elevation of an equalizer in accordance with the invention.
Figure 12:
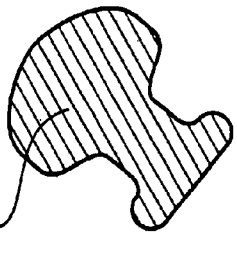
FIGS. 12 and 13 are sections showing the profile of the equalizer of FIG. 11.
Figure 13:
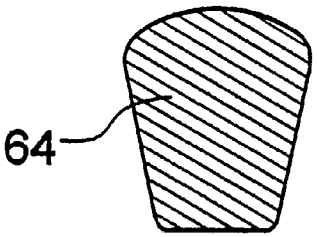

In FIGS. 11 to 13 is seen detail of an equalizer 59 extended hoist cable connector points 61,62 with a concave load bearing surface at 62. The profile of the bearing surface is seen in section views 63,64 (FIGS. 12,13). The transverse radius of the bearing surface, at the lowermost point (seen in FIG. 13) is ideally the same as the radius of the arcuate bearing surface of the equalizer engagement means.

The working surfaces of the ring and equalizer are ideally hard faced as is known to those skilled in the art. The hard facing may be applied by any of the standard techniques, the hard facing being applied by welding equipment to lay a coating down, or by tiling with tiles of hard facing bonded to the base surface in the zone of working of the parts. The area which is hard faced is ideally that area of contact of the respective parts over their range or surface contact during typical operation of the dragline bucket. The pins may be received in bushes as will be known to those skilled in the art.

Whilst in the preferred embodiment of the drawings there is seen an encircling member which is circularly symmetric in shape, it will be appreciated by those in the art that it is only the geometry of the working surfaces, the load bearing surfaces, over the range of relative angular movement, which are significant to the working of the invention such that there is no particular requirement or need attendant on or attached to the shape of the remainder of the encircling member. Bushes for pins may be press fit into bores in a casting, and welded in place.

The illustrated rigging is formed as a fabrication. The adaptor or link might be preferably formed as castings using techniques which will be clear to those skilled in that art.

What is claimed is:

1. A dragline rigging adaptor for supporting a dragline bucket from a hoist equalizer, said adaptor comprising:

a body having a hoist equalizer engaging aperture adjacent an upper end thereof, said body including bucket connectors on opposite sides thereof adjacent a lower end thereof, said body further including a forwardly directed dump block connector;

said equalizer engaging aperture having a substantially arcuate bearing surface to engage in use a hoist equalizer extending transversely therethrough, said arcuate bearing surface being substantially rounded in transverse section.

2. The dragline rigging adaptor to claim 1 wherein said bearing surface is hard faced.

3. The dragline rigging adaptor according to claim 1 wherein the equalizer engaging aperture is circular.

4. The dragline rigging adaptor according to claim 2 wherein the hard facing extends over the inner surface of said equalizer engaging aperture.

5. The dragline rigging adaptor according to claim 1 wherein said bucket connectors comprise spaced clevis lugs having aligned pin apertures.

6. The dragline rigging adaptor according to claim 1 wherein said dump block connector comprises spaced clevis lugs having aligned pin apertures.

7. A rigging system for a dragline bucket, said rigging system comprising:

an adaptor having a body having a hoist equalizer engaging aperture adjacent an upper end thereof, said body including bucket connectors on opposite sides thereof adjacent a lower end thereof, said body further including a forwardly directed dump block connector, said equalizer engaging aperture having a substantially arcuate bearing surface to engage in use a hoist equalizer extending transversely therethrough, said arcuate bearing surface being substantially rounded in transverse section; and a hoist equalizer, said equalizer having a transversely concave support surface engageable with said arcuate bearing surface.

8. The rigging system according to claim 7 wherein said concave support surface and said arcuate bearing surface are hard faced.

9. The rigging system according to claim 7 wherein the transversely concave support surface is substantially rounded in cross section.

10. The rigging system according to claim 9 wherein engagement between said bearing surface and said support surface permits relative angular movement therebetween.

* * * * *